US010250988B2

(12) United States Patent
Tanabe et al.

(10) Patent No.: US 10,250,988 B2
(45) Date of Patent: Apr. 2, 2019

(54) SPEAKER

(71) Applicant: ALPINE ELECTRONICS, INC., Tokyo (JP)

(72) Inventors: Kei Tanabe, Fukushima (JP); Masami Anzai, Fukushima (JP); Yu Yamagami, Fukushima (JP); Takahiro Aoki, Fukushima (JP); Yusuke Yoshida, Fukushima (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 15/667,261

(22) Filed: Aug. 2, 2017

(65) Prior Publication Data

US 2018/0084345 A1 Mar. 22, 2018

(30) Foreign Application Priority Data

Sep. 16, 2016 (JP) ..... 2016-182239

(51) Int. Cl.
*H04R 3/00* (2006.01)
*H04R 1/00* (2006.01)
(Continued)

(52) U.S. Cl.
CPC ..... *H04R 9/025* (2013.01); *H04R 7/127* (2013.01); *H04R 7/16* (2013.01); *H04R 9/06* (2013.01);
(Continued)

(58) Field of Classification Search
CPC .... H04R 2209/024; H04R 7/16; H04R 9/025; H04R 9/06
(Continued)

(56) References Cited

U.S. PATENT DOCUMENTS 5,664,024 A * 9/1997 Furuta ..... H04R 7/127 381/396
7,724,915 B2 * 5/2010 Matsumura ..... H04R 1/22 381/401
(Continued)

FOREIGN PATENT DOCUMENTS

EP 24322252 A1 3/2012
JP 57017300 1/1982
(Continued)

OTHER PUBLICATIONS

Extended European Search Report 17 19 1361, dated Jan. 26, 2018.

*Primary Examiner* — Khai N. Nguyen
(74) *Attorney, Agent, or Firm* — Brinks, Gilson & Lione

(57) ABSTRACT

A speaker in the present disclosure includes a magnetic circuit having a magnetic gap, a frame fixed to the magnetic circuit, a voice coil disposed in the magnetic gap, a cylindrical bobbin around which the voice coil is formed, and a diaphragm configured so that the inner circumferential side of the diaphragm is fixed to the bobbin and the outer edge of the diaphragm is supported by the frame with an edge member intervening therebetween. The diaphragm has an elliptical shape that is non-axisymmetric with respect to a center axis passing through the center of the bobbin. The diaphragm is formed by vacuum molding of a sheet-like raw material (thermoplastic CFRP sheet) in which long-fiber fillers are oriented in one direction in a thermoplastic resin. The orientation of the long-fiber fillers is set so as to match the short-axis direction of the diaphragm.

4 Claims, 3 Drawing Sheets

(51) Int. Cl.

| | |
|---|---|
| ***H04R 9/06*** | (2006.01) |
| ***H04R 11/02*** | (2006.01) |
| ***H04R 9/02*** | (2006.01) |
| ***H04R 7/16*** | (2006.01) |
| ***H04R 7/12*** | (2006.01) |
| ***H04R 31/00*** | (2006.01) |

(52) U.S. Cl.
CPC ..... *H04R 31/003* (2013.01); *H04R 2209/024* (2013.01); *H04R 2307/025* (2013.01); *H04R 2307/029* (2013.01)

(58) Field of Classification Search
USPC ..... 381/59, 111, 117, 184, 185, 193, 202, 381/347, 398, 400, 403, 405, 412, 423, 381/426, 428
See application file for complete search history.

(56) References Cited

U.S. PATENT DOCUMENTS

| | | | | |
|---|---|---|---|---|
| 9,479,874 | B2 * | 10/2016 | Shikimachi | H04R 1/2834 |
| 2003/0223613 | A1 * | 12/2003 | Hachiya | H04R 7/125 381/423 |
| 2007/0274556 | A1 * | 11/2007 | Matsumura | H04R 1/22 381/412 |
| 2012/0114136 | A1 * | 5/2012 | Horigome | H04R 9/02 381/86 |
| 2012/0263337 | A1 * | 10/2012 | Sakamoto | H04R 7/14 381/398 |
| 2016/0014519 | A1 * | 1/2016 | Oclee-Brown | H04R 7/00 381/398 |
| 2016/0134972 | A1 * | 5/2016 | Shibuya | H04R 7/10 381/405 |
| 2016/0212540 | A1 * | 7/2016 | Shibuya | H04R 7/06 |
| 2016/0277839 | A1 * | 9/2016 | Shikimachi | H04R 1/2834 |
| 2018/0084345 | A1 * | 3/2018 | Tanabe | H04R 7/16 |

FOREIGN PATENT DOCUMENTS

| | | |
|---|---|---|
| JP | 6437199 | 2/1989 |
| JP | 2005-223807 A | 8/2005 |
| JP | 2005223807 | 8/2005 |
| JP | 2007-221417 A | 8/2007 |
| JP | 2009-111802 A | 5/2009 |
| JP | 2013-162214 A | 8/2013 |

* cited by examiner

SPEAKER

RELATED APPLICATIONS

The present application claims priority to Japanese Patent Appln. No. 2016-182239, filed Sep. 16, 2016, the entire disclosure of which is hereby incorporated by reference.

BACKGROUND

1. Field of the Disclosure

The present disclosure relates to a speaker that generates sound pressure from the vibration of a diaphragm, and more particularly to a speaker that uses a diaphragm having a non-circular outside shape such as a track shape or an elliptical shape.

2. Description of the Related Art

A space in which a speaker can be installed may be largely restricted in the interior of a vehicle, a television set, and the like. Speakers that use a diaphragm in a track shape or an elliptical shape are widely known as speakers that can be installed even in a narrow space as described above.

Unlike a diaphragm having a circular outside shape, however, a diaphragm having a track shape or an elliptical shape as an outside shape is not axisymmetric, but has a non-axisymmetric shape having a short-axis direction and a long-axis direction. Therefore, this type of diaphragm has non-uniform shape stiffness, so stiffness at some portions on the diaphragm is low. Accordingly, a speaker using a non-axisymmetric diaphragm generates a natural vibration mode, which is determined according to the non-axisymmetric shape of the diaphragm, and thereby causes a peak dip in the voice band, which is important in voice frequency characteristics. This inhibits the speaker from producing a high-quality sound. Another problem is that, in a jump mode during a large input, a voice coil is also deformed in the natural vibration mode together with the diaphragm and comes in contact with a magnetic gap.

In view of this, a conventionally proposed technology reinforces portions with low shape stiffness on a non-axisymmetric diaphragm by forming thick portions in a rib shape along the long-axis direction and short-axis direction of the diaphragm as described in Japanese Unexamined Patent Application Publication No. 2005-223807. In another conventional technology proposed in Japanese Unexamined Patent Application Publication No. 2009-111802, reinforcing materials are formed by spraying natural fine fiber. These thick portions and reinforcing materials are used to locally improve the stiffness of the diaphragm.

SUMMARY

In the conventional technologies described in Japanese Unexamined Patent Application Publication Nos. 2005-223807 and 2009-111802, however, thick portions or reinforcing materials are formed on a diaphragm to compensate for reduction in shape stiffness, so these technologies have been problematic in that, after the thick portions or reinforcing materials have been added to the diaphragm, it has a new portion that is easily warped and that the total weight of the diaphragm is increased.

The present disclosure addresses the actual situations of these conventional technologies with the objective of providing a speaker that uses a non-axisymmetric diaphragm but produces high-quality sound and is highly reliable.

To address the above objective, a speaker in the present disclosure includes a magnetic circuit having a magnetic gap, a frame fixed to the magnetic circuit, a voice coil disposed in the magnetic gap, a cylindrical bobbin around which the voice coil is formed, and a diaphragm configured so that the inner circumferential side of the diaphragm is fixed to the bobbin and the outer edge of the diaphragm is supported by the frame with an edge member intervening therebetween. The diaphragm has a non-axisymmetric shape with respect to a center axis passing through the center of the bobbin. The diaphragm is made of a molded material including fibrous fillers, and the orientation of the fibrous fillers is set towards a radial direction in areas on the diaphragm, the areas having lower shape stiffness. That is, if the material stiffness of the diaphragm is assumed to be uniform, the diaphragm has first areas in which the amount of warp is increased during vibration and also has second areas in which the amount of warp is reduced during vibration. The orientation of the fibrous fillers is set so that the amount of wrap is reduced in the first areas.

With the speaker structured as described above, since the diaphragm is made of a molded material including fibrous fillers and the orientation of the fibrous fillers is set toward radial direction in areas on the diaphragm, the areas having lower shape stiffness, portions, on the diaphragm, at which its shape stiffness is low can be improved without having to take the trouble to add thick portions or reinforcing members to the diaphragm. This makes it possible to suppress an increase in the weight of the diaphragm and to suppress it from being non-uniformly warped during vibration. Therefore, even though the speaker uses a diaphragm in a non-axisymmetric shape, the speaker can improve sound quality and can increase reliability.

In the above structure, the diaphragm may have any outer shape if it is non-axisymmetric with respect to a center axis passing through the center of a bobbin. If, however, the speaker uses a diaphragm having an outer circumferential edge in a track shape or an elliptical shape and the voice coil is fixed to the central portion of the diaphragm, the orientation of the fibrous fillers is preferably set so as to match the short-axis direction of the diaphragm.

In the above structure, the diaphragm is preferably made of a sheet-like raw material in which fibrous fillers are oriented in one direction in a thermoplastic resin. When this type of sheet-like raw material is used, a diaphragm that is superior in mechanical characteristics can be manufactured at a low cost.

In this case, the diaphragm can also be formed by press molding or pneumatic molding. If, however, the diaphragm is formed by vacuum molding of a sheet-like raw material, the diaphragm can be easily manufactured to a desired shape.

Even though forms of the speaker according to the present disclosure uses a non-axisymmetric diaphragm, the speaker can improve sound quality and can increase reliability.

DETAILED DESCRIPTION OF THE DRAWINGS

Figure 1:
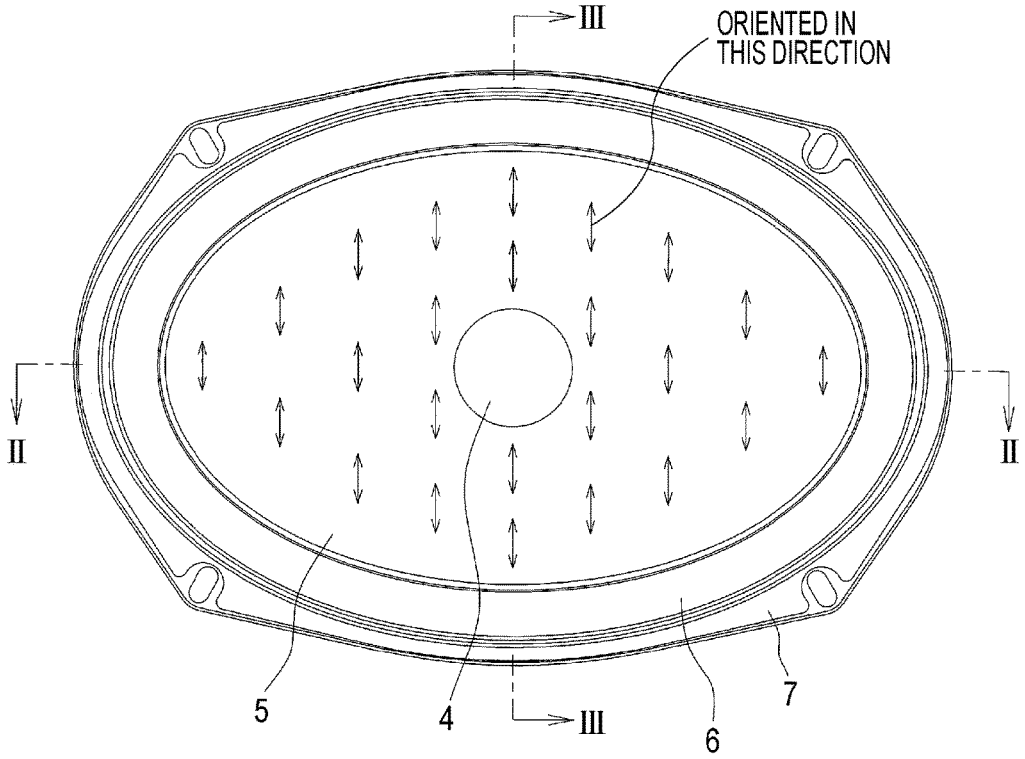
FIG. 1 is a plan view of one implementation of a speaker.
Figure 2:
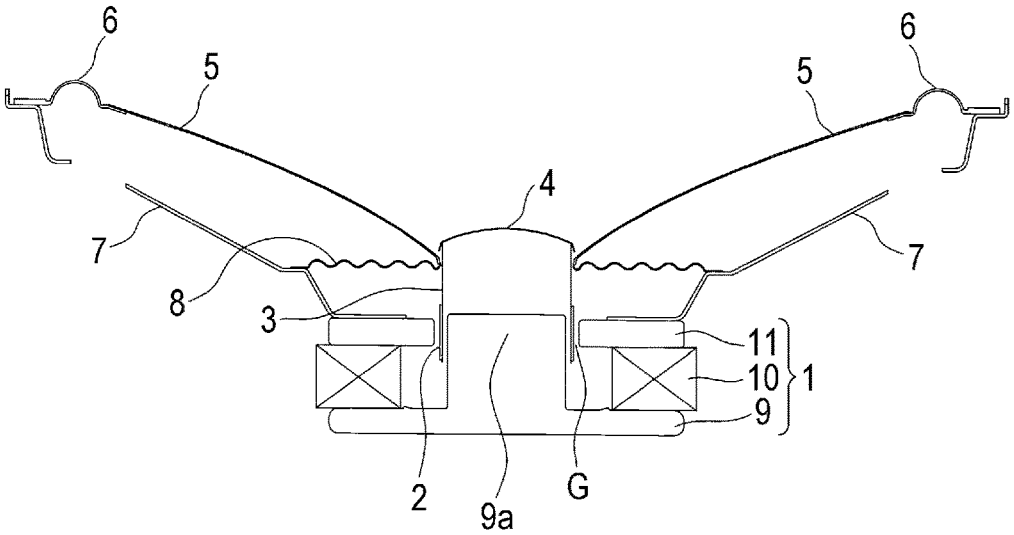
FIG. 2 is a cross-sectional view as taken line II-II in FIG. 1.
Figure 3:
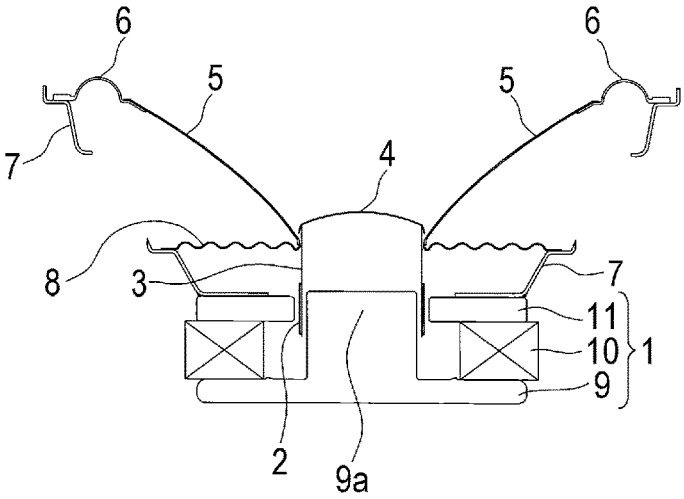
FIG. 3 is a cross-sectional view as taken line III-III in FIG. 1.

Implementations of the present disclosure will be described with reference to the drawings. As illustrated in FIGS. 1 to 3, a speaker may include a magnetic circuit 1 having a magnetic gap G, a voice coil 2, which is placed in the magnetic gap G and is driven due to electromagnetic interaction when a current passes, a bobbin 3, which is cylindrical and on which the voice coil 2 is formed, a cap 4 that blocks an opening formed at the top of the bobbin 3, a diaphragm 5 that vibrates together with the bobbin 3, a frame 7 that elastically supports the outer circumferential edge of the diaphragm 5 with an edge member 6 intervening therebetween, and a damper 8 disposed between the frame 7 and the upper end of the bobbin 3.

The magnetic circuit 1 may include a bottom plate 9 having a center pole 9*a*, a magnet 10, in a circular ring shape, which is placed on the bottom plate 9, and a top plate 11 in a circular ring shape, which is integrally placed on the bottom plate 9 with the magnet 10 intervening therebetween. The magnetic gap G is formed between the outer circumferential surface of the center pole 9*a* and the inner circumferential surface of the top plate 11.

The diaphragm 5 is a non-circular diaphragm having an elliptical outer shape. The central portion of the diaphragm 5 is fixedly bonded to the upper end of the bobbin 3. Specifically, the diaphragm 5 has a non-axisymmetric shape with respect to a center axis passing through the center of the bobbin 3. Due to this non-axisymmetric shape, the shape stiffness of the diaphragm 5 is not uniform. Specifically, with the diaphragm 5 used in this embodiment, the strength in the short-axis direction is lower than in the long-axis direction.

The edge member 6, which is made of a highly flexible material such as soft rubber, is integrated with the outer circumferential edge of the diaphragm 5 by using an adhesive or another means. The damper 8 is disposed between the frame 7 and the inner circumferential edge of the diaphragm 5. The diaphragm 5 is supported by the frame 7 so that the diaphragm 5 is vibrated by the damper 8 along the axial line of the bobbin 3.

With the speaker structured as described above, when a voice signal is input through a lead wire (not illustrated) extending from the voice coil 2, a current flow in the voice coil 2 and an electromagnetic driving force is exerted, so the bobbin 3 moves vertically along its axial line in the magnetic gap G according to the Fleming's left hand rule. The diaphragm 5 vibrates in response to the vertical movement of the bobbin 3, producing a voice output.

The diaphragm 5 is made of a sheet-like raw material in which fibrous fillers are oriented in one direction in polyamide resin or a thermoplastic resin such as polyamide resin. In this embodiment, a thermoplastic carbon fiber reinforced plastic (CFRP) sheet (N6/CF is 20%) is used in which long-fiber (such as carbon fiber with a length of 4 mm to 12 mm) fillers are oriented in nylon 6 resin in one direction. Although described later in detail, the diaphragm 5 is formed by vacuum molding of the thermoplastic CFRP sheet. During the vacuum molding, the orientation of the long-fiber fillers is set toward radial direction in areas on the diaphragm 5, the areas having lower shape stiffness. Since, in this implementation, the shape stiffness of the diaphragm 5 is low along the short axis, the orientation of the long-fiber fillers is set so as to match the short-axis direction of the diaphragm 5, as indicated by the arrows in FIG. 1. That is, if the material stiffness of the diaphragm 5 is assumed to be uniform, first areas in which the amount of warp of the diaphragm 5 is increased during vibration appear in the short-axis direction and second areas in which the amount of warp is reduced during vibration appear in the long-axis direction. Therefore, to reduce the amount of warp in the first areas, the orientation of the fibrous fillers is set so as to match the short-axis direction.

Figure 4A:
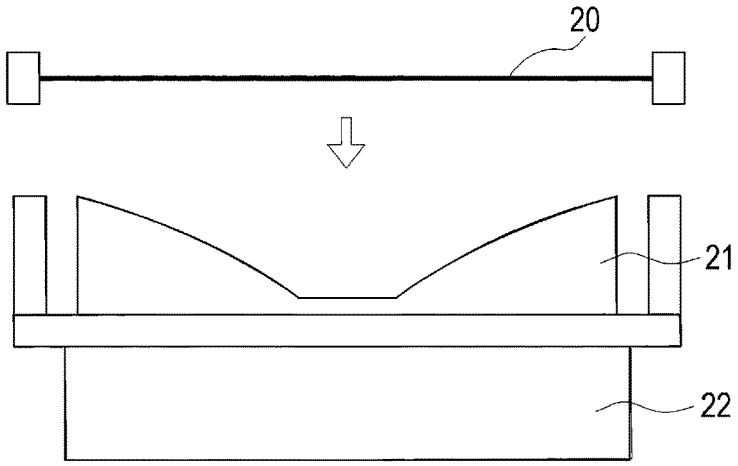
FIGS. 4A to 4C illustrate processes of manufacturing a diaphragm used in the speaker in FIG. 1.

Processes to manufacture the diaphragm 5 by vacuum molding will be described with reference to FIGS. 4A to 4C. First, the thermoplastic CFRP sheet 20 is heated with a heater (not illustrated) to soften the thermoplastic CFRP sheet 20 as illustrated in FIG. 4A. The thermoplastic CFRP sheet 20 is then lowered toward a die 21 while the state of the thermoplastic CFRP sheet 20 is maintained. At that time, it is necessary to place the thermoplastic CFRP sheet 20 on the die 21 so that the orientation of the long-fiber fillers included in the thermoplastic CFRP sheet 20 matches the short-axis direction of the diaphragm 5 obtained after the vacuum molding.

Figure 4B:
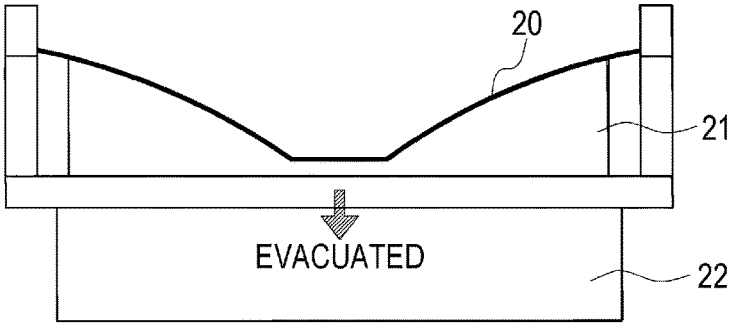
Figure 4C:
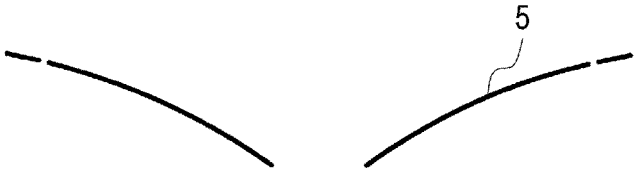

A vacuum pump 22 is operated to evacuate the space between the thermoplastic CFRP sheet 20 and the die 21 so as to bring the thermoplastic CFRP sheet 20 in tight contact with the die 21, as illustrated in FIG. 4B. After that, the thermoplastic CFRP sheet 20 is cooled to solidify it, after which the thermoplastic CFRP sheet 20 is taken out of the die 21. Then, the outer circumferential edge and central portion of the thermoplastic CFRP sheet 20 are die-cut. This completes the manufacturing of the diaphragm 5 in a non-axisymmetric shape in which the outer shape is elliptical as illustrated in FIG. 4C.

As described above, with the speaker in this implementation, the diaphragm 5 has an elliptical shape that is non-axisymmetric with respect to a center axis passing through the center of the bobbin 3. The diaphragm 5 is made of a sheet-like raw material (thermoplastic CFRP sheet 20) in which long-fiber fillers are oriented in one direction in a thermoplastic resin. The orientation of the long-fiber fillers is set so as to match the short-axis direction of the diaphragm 5. Therefore, the mechanical strength at portions, on the diaphragm 5, at which its shape stiffness is low can be improved by the long-fiber fillers oriented in this way. This eliminates the trouble to add thick portions or reinforcing members to the diaphragm 5. This makes it possible to suppress an increase in the weight of the diaphragm 5 and to suppress it from being non-uniformly warped during vibration. Therefore, even though the speaker uses the diaphragm 5 in a non-axisymmetric shape, the speaker can improve sound quality and can increase reliability.

With the speaker in this implementations, since the diaphragm 5 is obtained from a sheet-like raw material (thermoplastic CFRP sheet 20) by vacuum molding in which the thermoplastic CFRP sheet 20 is brought into tight contact with the die 21 and the space between them is evacuated by the vacuum pump 22, the manufacturing cost including the price of the die 21 is low and the diaphragm 5 with a desired shape can be easily manufactured.

Although, in the above implementation, a case in which the diaphragm 5 having an elliptical outer shape is used has been described, the outer shape of the diaphragm 5 is not limited to an elliptical shape. The diaphragm 5 may have any other outer shape that is non-axisymmetric with respect to a center axis passing through the center of a bobbin. For example, a diaphragm having a track shape or a polygonal shape may be used. Another example is a diaphragm called an oblique cone, in which a voice coil (bobbin) is placed at a position deviated from the central portion of the diaphragm.

Although, in the above implementation, the orientation of long-fiber fillers is set so as to match the short-axis direction of the diaphragm 5 having an elliptical outer shape, the non-uniformity of the shape stiffness of the diaphragm 5 is not determined according to only the outer shape but is determined according to a whole shape including a curved shape extending from the inner circumferential edge on the same side as the bobbin 3 to the outer circumferential edge on the same side as the edge member 6. If, for example, areas in which the shape stiffness, which is determined according to the whole shape of a diaphragm used, is low are present in the long-axis direction, it is necessary to set the orientation of the long-fiber fillers so as to match the long-axis direction of the diaphragm.

Although, in the above implementation, a case has been described in which vacuum molding is used as a means for manufacturing the diaphragm 5 from a sheet-like raw material (thermoplastic CFRP sheet 20), this is not a limitation. In the manufacturing of a diaphragm from a sheet-like raw material, it is also possible to use pneumatic molding, in which the sheet-like raw material is softened by being heated and the softened raw material is pressurized in a die to obtain a desired shape or to use press molding, in which the sheet-like raw material is softened by being heated and the softened raw material is clamped between an upper die and a lower die.

It is therefore intended that the foregoing detailed description be regarded as illustrative rather than limiting, and that it be understood that it is the following claims, including all equivalents, that are intended to define the spirit and scope of this invention.

What is claimed is:

1. A speaker comprising:

a magnetic circuit having a magnetic gap;

a frame fixed to the magnetic circuit;

a voice coil disposed in the magnetic gap;

a cylindrical bobbin around which the voice coil is formed; and a diaphragm configured so that an inner circumferential side of the diaphragm is fixed to the bobbin and an outer edge of the diaphragm is supported by the frame with an edge member intervening between the outer edge and the frame;

wherein:

the diaphragm has a non-axisymmetric shape with respect to a center axis passing through a center of the bobbin, and the diaphragm is made of a molded material including a fibrous filler, and wherein:

an orientation of the fibrous filler is set to match a short-axis direction of the diaphragm when an area having low shape stiffness is present in the short-axis direction and an area having high shape stiffness is present in a long-axis direction; or an orientation of the fibrous filler is set to match the long-axis direction of the diaphragm when an area having low shape stiffness is present in the long-axis direction and an area having high shape stiffness is present in the short-axis direction.

2. The speaker according to claim 1, wherein:

an outer circumferential edge of the diaphragm has a track shape or an elliptical shape;

the voice coil is fixed to a central portion of the diaphragm; and the orientation of the fibrous filler is set so as to match a short-axis direction of the diaphragm.

3. The speaker according to claim 1, wherein the diaphragm is made of a sheet-like raw material in which the fibrous filler is oriented in one direction in a thermoplastic resin.

4. The speaker according to claim 3, wherein the diaphragm is formed by vacuum molding of the sheet-like raw material.

* * * * *